US006616477B1

(12) United States Patent
Chang

(10) Patent No.: US 6,616,477 B1
(45) Date of Patent: Sep. 9, 2003

(54) HIGH FREQUENCY ELECTRICAL CONNECTOR

(75) Inventor: Che-Chia Chang, Taipei (TW)

(73) Assignee: Comax Technology Inc., Taipei (TW)

( * ) Notice: Subject to any disclaimer, the term of this patent is extended or adjusted under 35 U.S.C. 154(b) by 0 days.

(21) Appl. No.: 10/187,359

(22) Filed: Jul. 2, 2002

(30) Foreign Application Priority Data

Mar. 21, 2002 (TW) ..... 91203454 U

(51) Int. Cl.[7] ..... H01R 13/58
(52) U.S. Cl. ..... 439/465; 439/449; 439/731
(58) Field of Search ..... 439/731, 465, 439/455, 460, 351, 353, 355, 449

(56) References Cited

U.S. PATENT DOCUMENTS 4,514,029 A * 4/1985 Lax et al. ..... 439/610
4,619,494 A * 10/1986 Noorily et al. ..... 439/449
4,767,362 A * 8/1988 Moji ..... 439/610
4,838,808 A * 6/1989 Fujiura ..... 439/357
4,917,629 A * 4/1990 Matsuzaki et al. ..... 439/405
5,244,415 A * 9/1993 Marsilio et al. ..... 439/610
5,338,227 A * 8/1994 Nakamura ..... 439/607
5,342,216 A * 8/1994 Davis et al. ..... 439/362
5,389,006 A * 2/1995 Noschese ..... 439/354
5,601,447 A * 2/1997 Reed et al. ..... 439/404
5,609,499 A * 3/1997 Tan et al. ..... 439/445
5,954,542 A * 9/1999 Wu et al. ..... 439/610

* cited by examiner

*Primary Examiner*—Lynn Feild
*Assistant Examiner*—Hae Moon Hyeon
(74) *Attorney, Agent, or Firm*—Troxell Law Office PLLC

(57) ABSTRACT

A high frequency electrical connector that includes an insulation body with contact terminals, a lead wire connected to the contact terminals and a casing enclosing the insulation body and the lead wire. The insulation body at a position close to the contact terminals has a fixing end and the casing is composed of a first lid and a second lid with each of the first and the second lids having an extension part. The extension part can engage with a plastic outer mold and each of the first and the second lids at two opposite lateral sides has an engaging end respectively for engaging with the fixing end. Clearances are formed between the contact terminals without an obstruction therebetween such that the electrical connector can possess excellent property with high frequency.

3 Claims, 4 Drawing Sheets

HIGH FREQUENCY ELECTRICAL CONNECTOR

BACKGROUND THE INVENTION

1. Field of the Invention

The present invention relates to an electrical connector, and particularly to an electric connector being provided with clearances between a plurality of contacts and the clearances are not stuffed with any medium so that the electric connector can have excellent characteristic of high frequency.

2. Description of Related Art

An electric connector currently used usually includes an insulation body and a plurality of contact terminals and the contact terminals are inserted into terminal sockets disposed in the insulation body. Then, a lead wire is soldered to the contact terminals and finally, the insulation body, the lead wire and the contact terminals are covered with an injected plastic outer mold such that a finish product of an electric connector with an outer mold can be formed accordingly.

However, original clearances disposed between the contact terminals are filled with the outer mold during the process of the insulation body, the contact terminals and the lead wire being covered with the plastic outer mold. Thus, the media between the contact terminals has to be the plastic outer mold but the plastic outer mold itself does not provide excellent effect of conduction so that it results in the connector has a relatively poor property for owning high frequency so as to affect the connector during in a state of using.

SUMMARY OF THE INVENTION

Accordingly, a main object of the present invention is provide an electric connector with a plurality of contact terminals keeping a clearance between any two of the contact terminals without any stuffed medium such that the electric connector is possible to provide an excellent property with high frequency.

In order to achieve the object, the electrical connector of the present invention includes an insulation body with contact terminals, a lead wire connected to the contact terminals and a casing enclosing the insulation body and the lead wire. The insulation body at a position thereof close to the contact terminals has a fixing end and the casing is composed of a first lid and a second lid with each of the first and the second lids at an end thereof having an extension part. The extension part can engage with a plastic outer mold and each of the first and the second lids at two opposite lateral sides thereof has an engaging end respectively for engaging with the fixing end. Clearances are formed between the contact terminals and free of being stuffed with any medium such that the electrical connector can has excellent property of owning high frequency.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENTS

Figure 1:
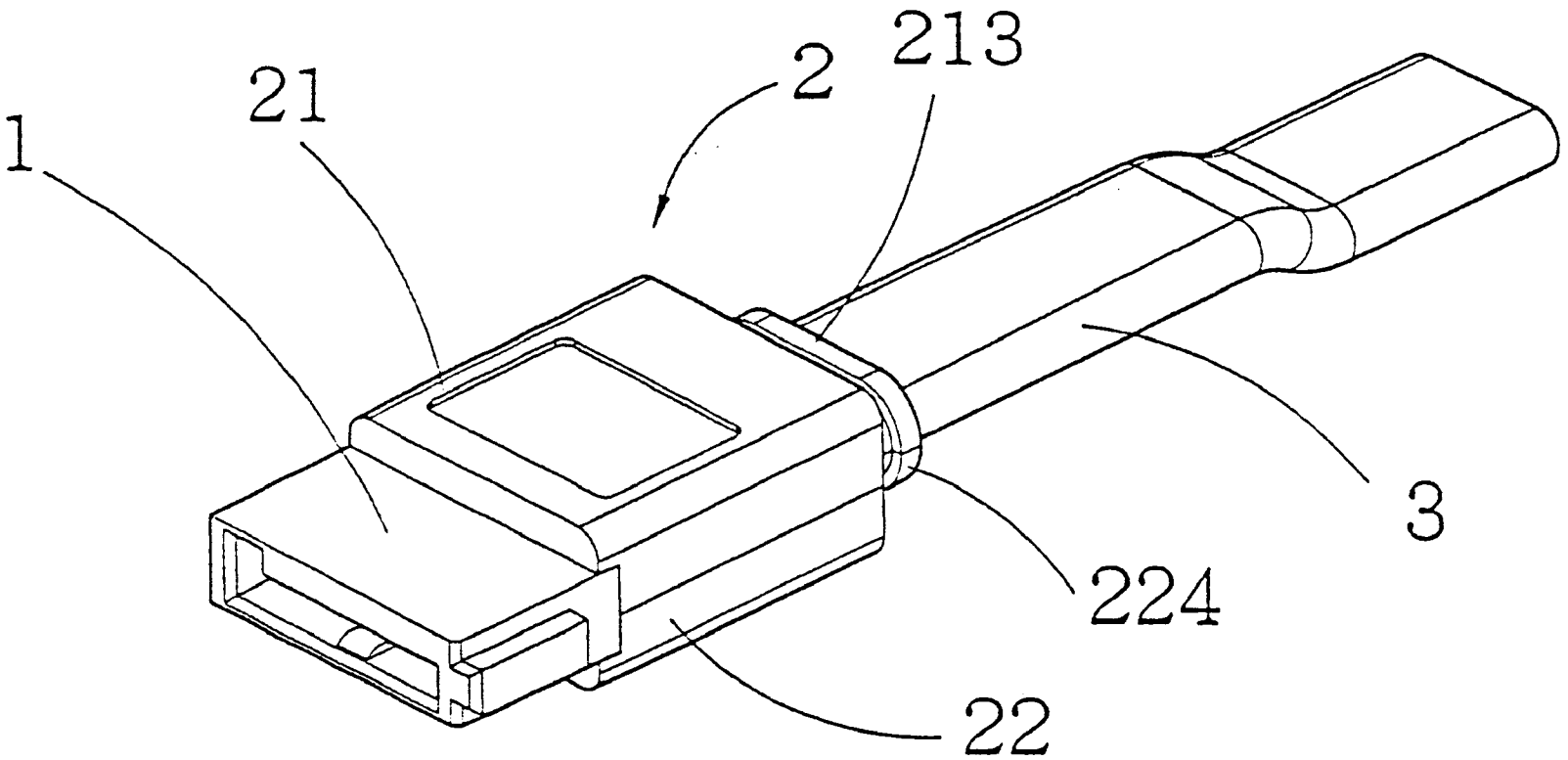
FIG. 1 is a perspective view of an electric connector according to the present invention.
Figure 2:
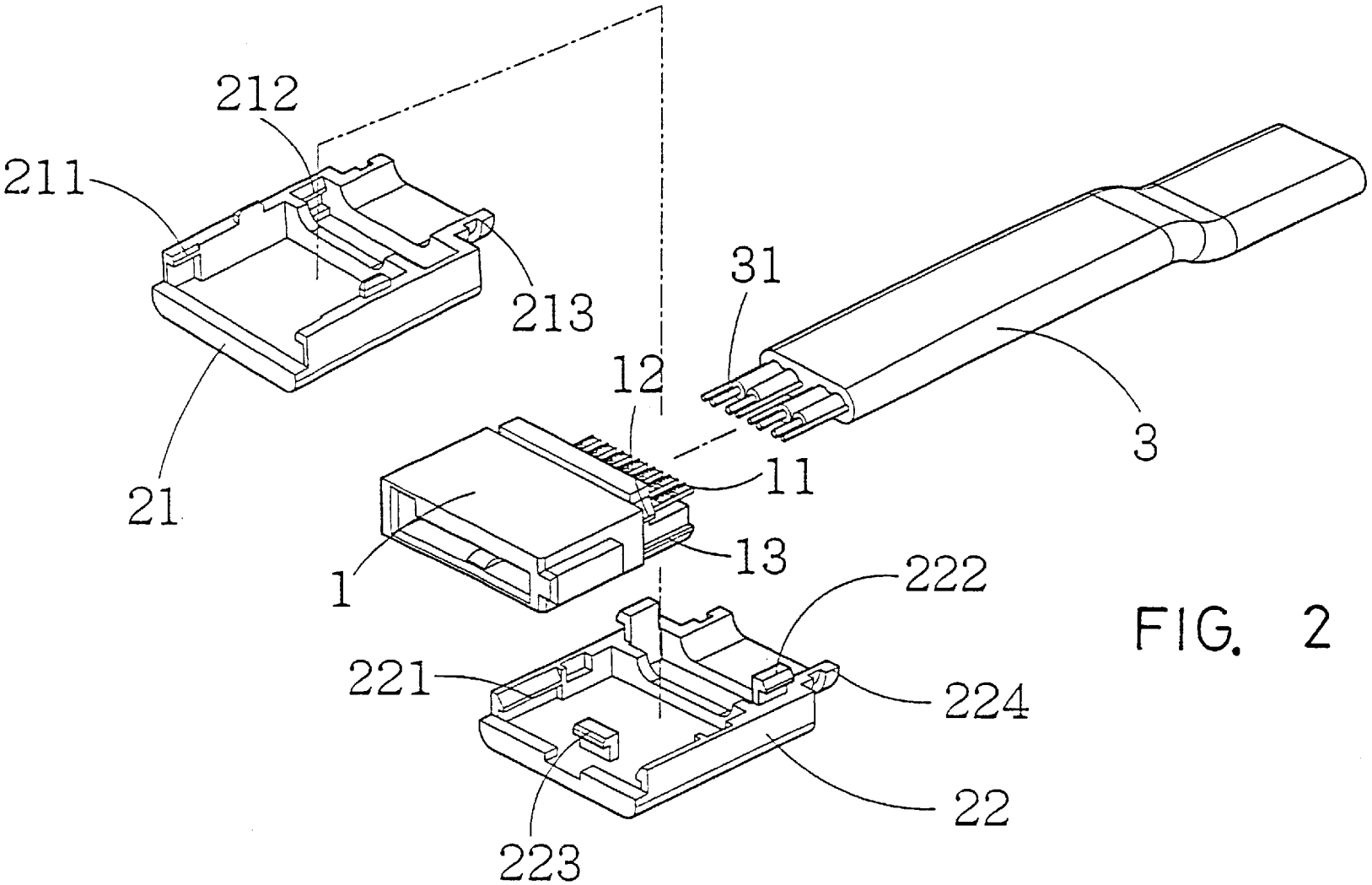
FIG. 2 is an exploded perspective view of the electric connector shown in FIG. 1.

Referring to FIGS. 1 and 2, this invention is an improvement on an electrical connector, comprising of an insulation body 1 with a plurality of contact terminals 11 and a casing 2. Making use of the mentioned structure, clearances can be formed between the contact terminals 11 without being stuffed any medium and thus ensuring the excellent high frequency properties of the electrical connector.

The contact terminals 11 on the above-mentioned insulation body 1 electrically connect with a lead wire 3. A fixing end is located at a reserved position on the insulation body 1 close to the contact terminals 11. The fixing end is composed of an upper connecting part 12 and a lower connecting part 13. Furthermore, the insulation body 1 at the lower side thereof is pierced a through hole 14 at a preset position (shown in FIG. 4).

The casing 2, which is composed of the first lid 21 and the second lid 22, surrounds the exterior of the insulation body 1 and the lead wire 3. An end of the first lid 21 and an end of the second lid 22 extends an extension part 213, 224 respectively. The extension parts 213, 224 each have a shape of concaved ring respectively for being joined to a plastic outer mold. Moreover, each of the first and second lids (21, 22) at both lateral sides thereof has a respective engaging end for an upper connecting part 12 and a lower connecting part 13 on the insulation body 1 being joined to each other. The engaging end is composed of a respective upper engaging part 211 on two lateral sides the first lid 21 and a respective lower engaging part 221 on the second lid 22 such that it is possible for the engaging end to engage with the respective upper connecting part 12 and the respective lower connecting part 13. Furthermore, the first lid 21 at two opposite lateral sides thereof is provided with a catch part 212 respectively and the second lid 22 at two opposite lateral sides thereof is provided with a lock part 222 corresponding to the catch part 212 such that the catch part 212 and lock part 222 can engage with each other. A hook part 223, which is located at an end of the second lid 22, will hook up with the hole 14 at the bottom of the insulation body 1. This will enhance immobilization of the upper and the lower lids. Hence, the preceding structure is a completely new for an electrical connector.

Figure 3:
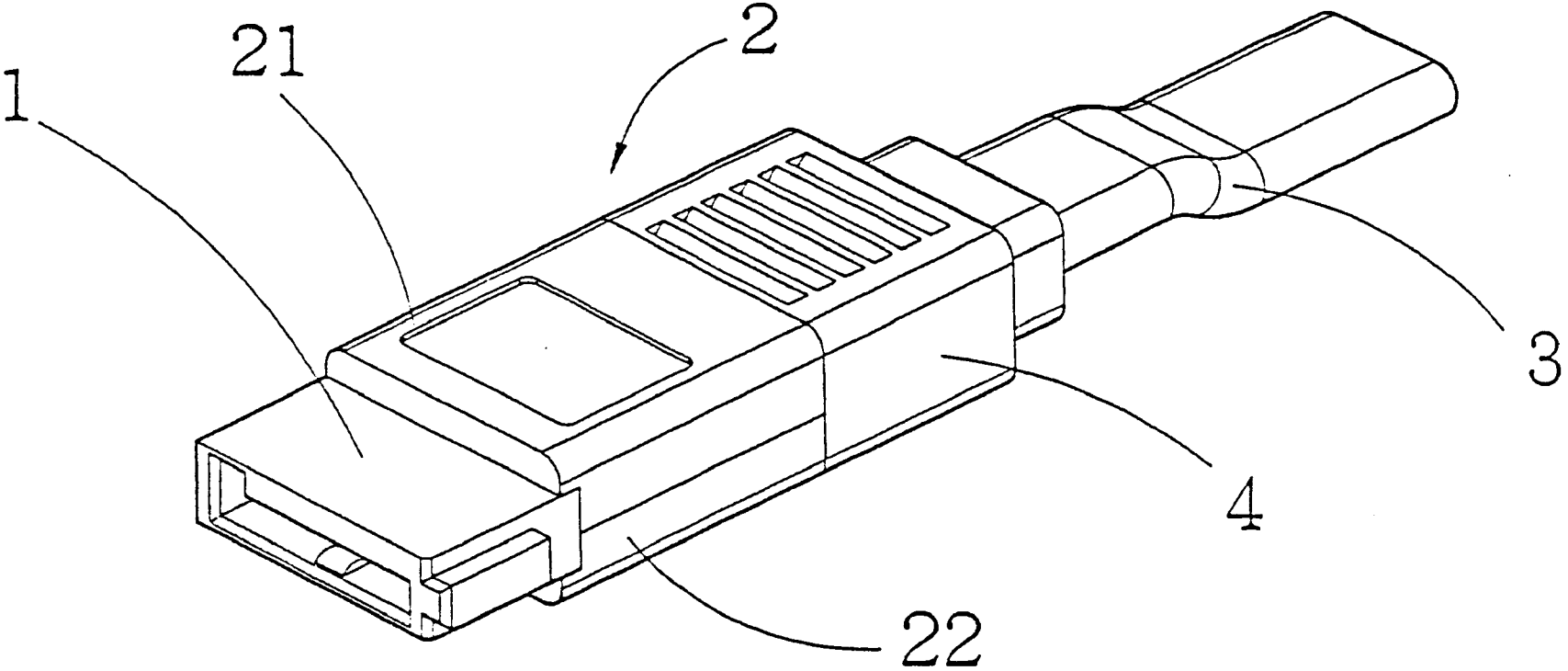
FIG. 3 is a perspective view illustrating the electric connector in a preferred embodiment thereof.
Figure 4:
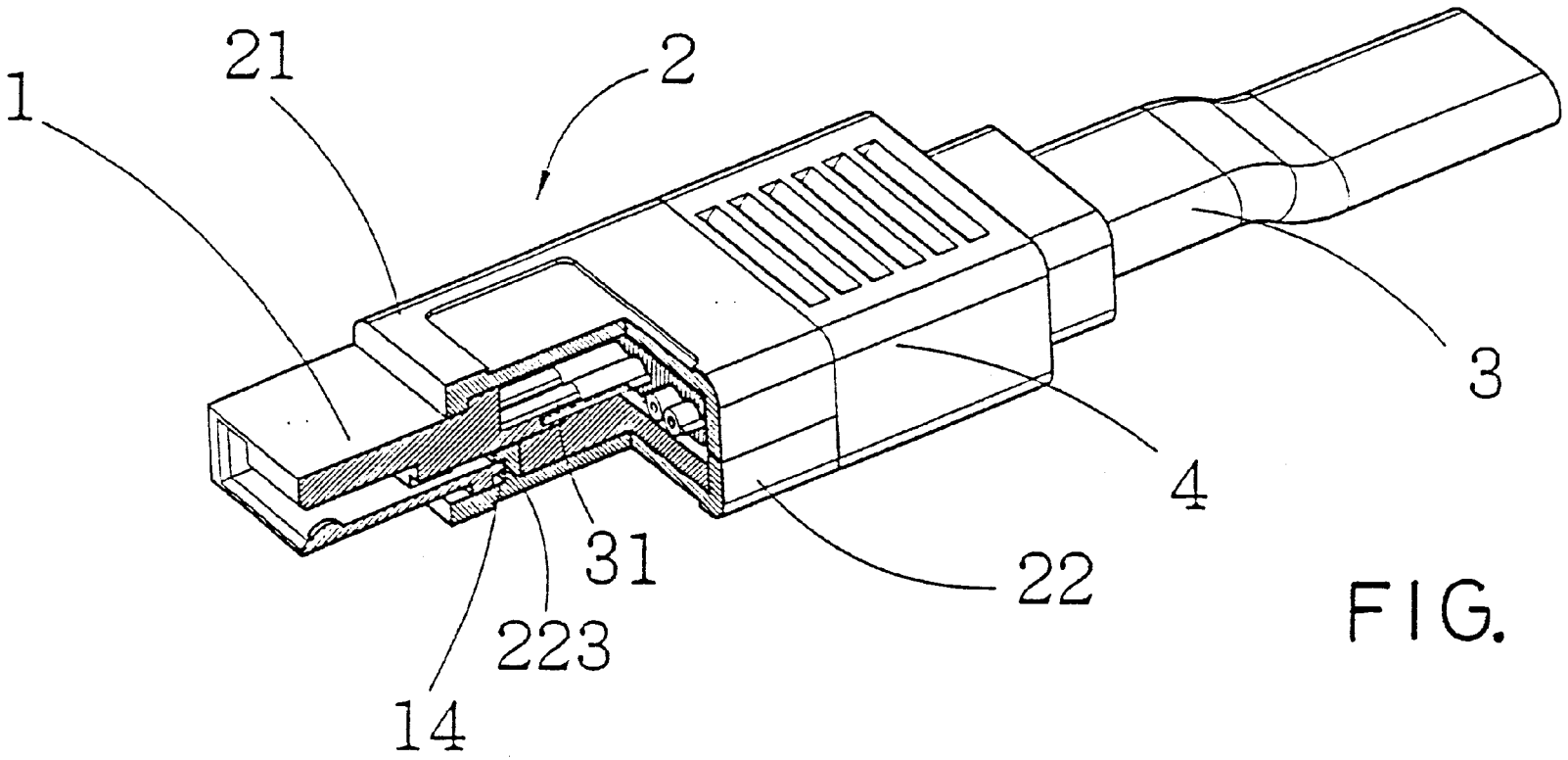
FIG. 4 is a perspective sectional view of FIG. 3.

Referring to FIGS. 3 and 4 in company with FIG. 2 again, during assembling the electrical connector of the present invention, wire cores 31 of the lead wire 3 are connected to the contact terminals 11 electrically. Then, the lower connecting part 13 of the insulation body 1 can be engaged to the lower engaging part 221 of the second lid 22. At the same time, the hook part 223 on the second lid 22 will hook the hole 14 in the bottom of the insulation body 1. Afterwards, the upper engaging part 211 on the first lid 21 will engage With the corresponding upper connecting part 12 of the insulation body 1. Simultaneously, making use of the catch part 212 and the lock part 222, the first lid 21 and the second lid 22 can be attached to each other and allows the casing 2 to enclose exterior of the insulation body 1 and lead wire 3. After that, the plastic material is injected into a plastic outer mold 4 and this will allow the extension parts 213, 224 and the lead wire 3 to be wrapped by the plastic outer mold 4. As the extension parts 213, 224 form a concaved ring structure, the outer plastic mold 4 is capable of performing an effect of catch with the extension parts 213, 224. Thus, the plastic outer mold 4 will be stabilized in wrapping around the extension parts 213, 224 and the conducting wire 3. Furthermore, the plastic outer mold 4 only wraps around the conducting wire 3 and the extension parts 213, 224 of the first and second lid 21, 22; no plastic material will be injected into casing 2. As a result, there is no medium in the clearances between the contact terminals 11. Since no any substance is a medium better than the air, it leads to the electrical connector to possess excellent characteristics of high frequency.

While the invention has been described with reference to the a preferred embodiment thereof, it is to be understood that modifications or variations may be easily made without departing from the spirit of this invention, which is defined by the appended claims.

What is claimed is:

1. A high frequency electrical connector with contact terminals that have no insulation material between the contact terminals, comprising:

a) an insulation body having a fixing end and a plurality of contact terminals, the fixing end having upper connecting parts and lower connecting parts on two lateral sides of the insulation body;

b) a lead wire having a plurality of wire cores, one end of each wire core being connected to one of the plurality of contact terminals;

c) a casing including a first lid and a second lid, the first lid having first engaging parts on two lateral sides, catch parts on two lateral sides and a first extension part, the second lid having second engaging parts on two lateral sides, lock parts on two lateral sides and a second extension part, whereby the second casing lid is connected to the insulation body by engagement of the second engagement parts with the lower connecting parts, and the first lid is connected to the insulation body by engagement of the first engaging parts and the upper connecting parts, and connected to the second casing lid by engagement of the catch parts and the lock parts, such that the contact terminals are enclosed by the casing; and, d) an outer mold formed around extension parts of the first and second casing and the lead wire to stabilize the casing and the lead wire relative to each other.

2. The high frequency electrical connector, according to claim 1, wherein the first extension part and the second extension part each have an external concave ring, and the outer mold is formed around the first extension part, the second extension part, and the lead wire.

3. The high frequency electrical connector, according to claim 1, further comprising a hole on a bottom side of the insulation body; and a hook on an inside of the second lid of the casing whereby the hook is hooked to the insulation body through the hole.

* * * * *